United States Patent [19]

Stumpf et al.

[11] 4,446,663

[45] May 8, 1984

[54] ACOUSTICAL PAD

[75] Inventors: William S. Stumpf; Gary R. Ludwig, both of Kitchner, Canada

[73] Assignee: Hauserman Ltd., Waterloo, Canada

[21] Appl. No.: 224,892

[22] Filed: Jan. 14, 1981

[51] Int. Cl.[3] ..... E04B 1/82

[52] U.S. Cl. ..... 52/144; 52/239; 181/287; 181/290

[58] Field of Search ..... 160/135, 351; 52/309.7, 52/144, 239, 357, 358, 222, 712, 656, 241; 181/290, 284, 291, 295, 287

[56] References Cited

U.S. PATENT DOCUMENTS

| | | | |
|---|---|---|---|
| 3,200,913 | 8/1965 | Nelson | 52/656 |
| 3,321,223 | 5/1967 | Snow | 52/656 |
| 3,934,382 | 1/1976 | Gartung | 52/144 |
| 4,042,061 | 8/1977 | Murakami | 181/290 |
| 4,112,643 | 9/1978 | Decker | 52/222 |
| 4,215,765 | 8/1980 | Harris | 52/144 |

FOREIGN PATENT DOCUMENTS

| | | | |
|---|---|---|---|
| 863611 | 3/1961 | United Kingdom | 181/290 |

OTHER PUBLICATIONS

Progressive Architecture, Jul. 1961, Interior Design Data; p. 131.

*Primary Examiner*—John E. Murtagh
*Assistant Examiner*—Kathryn L. Ford
*Attorney, Agent, or Firm*—Maky, Renner, Otto & Boisselle

[57] ABSTRACT

A readily removable and replaceable acoustical pad for an interior space dividing system of the type having horizontal and vertical frames forming generally rectangular pad receiving windows with the upper horizontal frame member of each window having a depending flange or flanges forming a tongue, each pad having an upwardly opening central groove along the top edge adapted to mate with the tongue whereby the pad may be inserted in the window by first mating the groove with the tongue and then pivoting the pad to a vertical position into a snug fit in the window. The pad is preferably foam and fabric covered to deform along the bottom, vertical and groove spaced top edges to obtain the snug fit, and includes a frame, the upper element of which forms a V-shape groove. A metal septum is centrally positioned in the frame with fiberglass pads on each side, within the frame. Options include one half size foam covers with tack boards either directly fabric covered or with a one quarter size foam cover option. The fabric completely encases the pad and the free edges thereof are tucked into and secured to the inside of the frame forming the top groove.

31 Claims, 6 Drawing Figures

ACOUSTICAL PAD

This invention relates as indicated to an acoustical pad and more particularly to a readily removable and replaceable acoustical pad for interior space dividing systems of the type shown in the copending application of Douglas C. Ball et al Ser. No. 81,437 filed Oct. 3, 1979 entitled "Space Divider System".

BACKGROUND OF THE INVENTION

In such copending application there is disclosed a space divider system for interiors in which a horizontal beam supports electrical and communication wiring ducts at substantially work surface height. Posts extend upwardly from the ducts to support light fixtures and horizontal rails. The posts may serve as electrical conduits for such light fixtures or for ceiling access wiring to the system. The rails are designed for hanging at any point therealong upper storage units. The posts and rails form rectangular frames which may be left open to form windows or may be closed by acoustical pads. Such acoustical pads provide visual privacy and, of course, sound absorption while not restricting the use of or position of hanging storage components.

One of the principle problems in open office interiors is sound privacy. The problem is particularly aggravated by increasing use of modern office equipment such as computers, typewriters, telecommunications equipment and the like. Accordingly, it is important to provide an acoustical pad or panel which will not only provide sound proofing between adjacent work stations, but which will also absorb and reduce the overall noise level in the ambient environment of the open office.

It is also important that acoustical pads in such system be readily removable and replaceable to achieve both visual and functional variations and also without affecting or restructing the use or position of upper storage units. In any working or living environment, the ability readily to redecorate or rearrange furniture or components is an awarding and desirable advantage.

In such prior copending application, to form the horizontal rails extending between the vertical posts, back-to-back angles are employed which are periodically deformed along their depending flanges to be joined by welding together. This forms a structural T with the stem of the T formed by a depending double flange. Such rigidity is necessary for hanging upper storage units at any position therealong. The structural depending double flange thus formed, however, creates a problem in providing an acoustical pad to close fully the window provided by such horizontal frame members. Prior attempts to solve this problem have included two pads hung from the frame on opposite sides of the central depending flange. Such pads have not been economically viable and have not provided the desired visual and sound seals.

SUMMARY OF THE INVENTION

With the present invention, a readily removable and replaceable acoustical pad for an interior space dividing system is provided which has a slot along the top edge thereof. Such pad is adapted to mate with the tongue formed by the flange or flanges of the horizontal rails so that the pad may be inserted in the window formed by the frame members by first inserting the pad so that the groove first mates with the tongue of the top frame member and then may be pivoted into a snug fit in the window. The groove in the top of the pad may be an upwardly opening truncated V to facilitate the insertion and removal of the pad within the frame of the window. The V is formed by a top frame element with in the pad. The V-groove is also employed to tuck the free edges of the fabric envelope of the pad out of sight for securing to the frame of the pad. The frame of the pad is rectangular in shape and formed by readily joined elements. A metal septum is provided in the middle of the frame with the frame encasing fiberglass pads on each side of the septum. Exteriorly of the pad there is provided foam padding which is covered externally by fabric. The frame and septum with the fiberglass pad is common to each acoustical pad of the system. The pad is designed to deform along the bottom, vertical, and slightly groove spaced top edges to obtain a snug fit within the window frame. While the pads of the present invention use a common frame, septum and fiberglass pads, the foam and fabric covering may vary. Options include foam cover with tack boards either directly fabric covered or with a one quarter size foam cover option.

It is accordingly a principle object of the present invention to provide an acoustical pad for interior space divider systems which can readily be removed and replaced without requiring tools or specialized technical help.

Another important object is the provision of an acoustical pad which utilizes and takes advantage of the special horizontal rail construction of the aforementioned space divider system to enable the same to be readily inserted and removed and when inserted to be firmly secured in place.

Another important object is the provision of an acoustical pad which will not only provide the tight visual privacy and sound proofing desired between adjacent stations in an open office plan but which will also absorb and reduce the ambient level of noise.

Still another object is the provision of an acoustical pad having a top groove therealong which may be mated with the depending tongue of a horizontal rail to be inserted first into mating relationship with the tongue and the groove of the pad to be then pivoted into a snug fit in the balance of the frame.

It is also an important object to provide a pad which when inserted will deform along its horizontal and vertical edges snugly to fit with the window frame into which it is inserted.

Another object is the provision of a top groove acoustical pad which deforms along two horizontally spaced top edges on opposite sides of the groove to obtain the snug fit along the top thereof.

A further object is the provision of an acoustical pad which is economical in manufacture having many common elements yet having a wide variety of options such as tack boards either directly fabric covered or foam and fabric covered.

A further object is the provision of an acoustical pad utilizing a top groove in which to tuck the free edges of a fabric envelope for securing purposes.

Other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
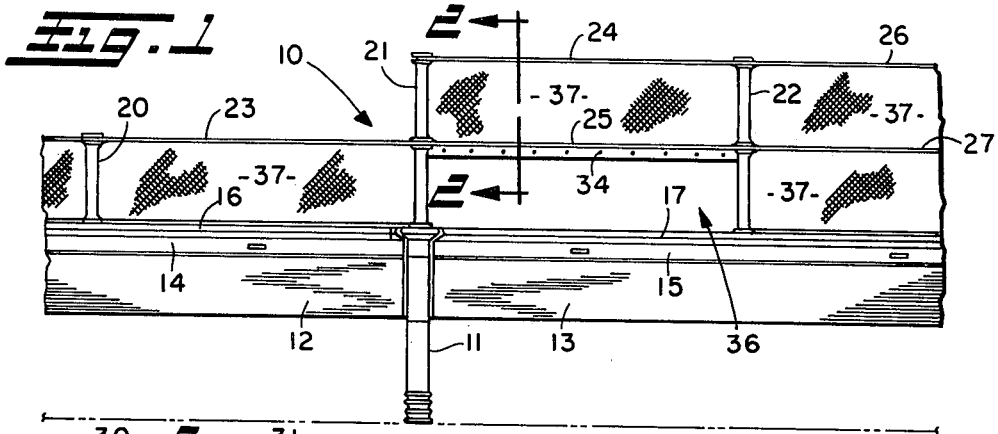
FIG. 1 is a side elevation of a space divider system in accordance with the present invention illustrating acoustical pads in accordance with the present invention in location in some of the window frames provided by the system.

Referring first to FIG. 1, there is illustrated a space divider system shown generally at 10 which comprises a plurality of legs 11 supporting horizontally extending beams 12 and 13 above the floor with electrical conduits 14 and 15 on the top thereof, on top of which are communication wiring conduits as seen at 16 and 17.

Extending upwardly from the beam and the conduits on the top thereof are posts seen at 20, 21 and 22. Extending between the posts are horizontal rails seen at 23, 24, 25, 26 and 27. The horizontal rails are secured to the posts 21 and 22 in the manner disclosed more fully in copending application Ser. No. 81,437 as noted above and each comprise back-to-back angles as seen more clearly in FIGS. 2 and 3.

Figure 2:
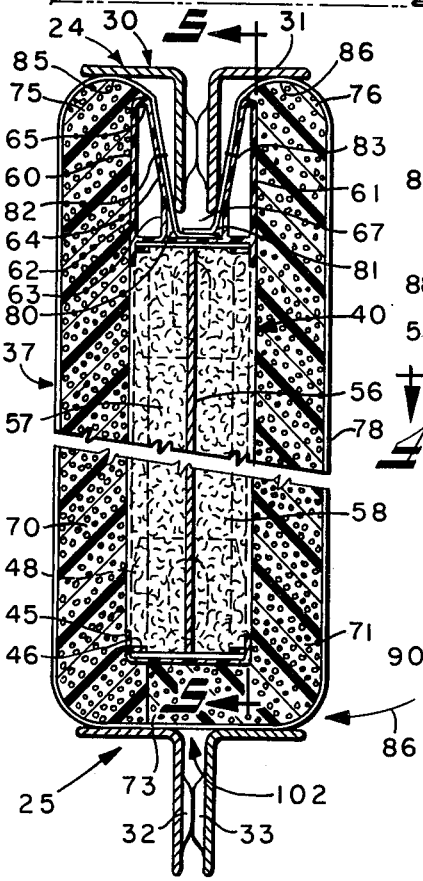
FIG. 2 is a vertical section through a pad in accordance with the present invention in position between horizontal frames of the space divider system as seen from the line 2—2 of FIG. 1.
Figure 3:
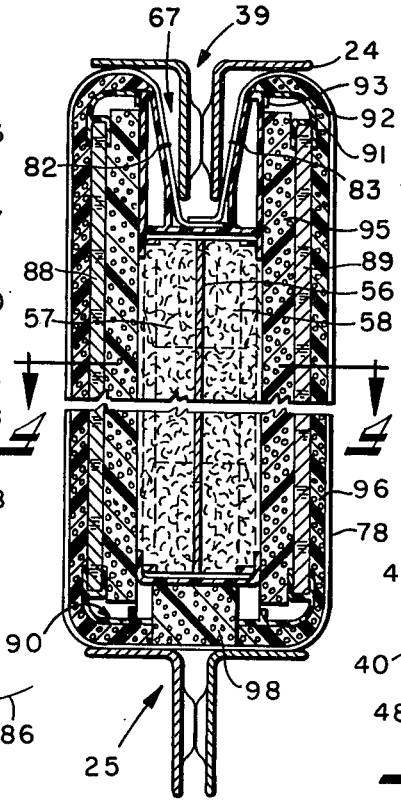
FIG. 3 is a view similar to FIG. 2 but illustrating another embodiment of the present invention utilizing tack boards with a quarter size foam covering.

As seen more clearly in FIGS. 2 and 3 the horizontal elements 23 through 27 extending between the posts 20, 21 and 22 above the communications wiring conduit 17 are formed of back-to-back angles seen at 30 and 31 in FIG. 2. The depending leg of each angle is periodically deformed as seen at 32 and 33 and such legs are spot welded to each other at the deformations along the length of the frame as seen at 34 in FIG. 1. In this manner a T-shape frame element is provided wherein the stem of the T comprises the slightly spaced vertical legs of the angles. This permits hanging components to be supported from the frame system as seen in the aforementioned copending application Ser. No. 81,437.

The space dividing system then forms above work surface height a plurality of rectangular windows which may remain open as seen at 36 in FIG. 1 or may be closed by acoustical pads 37. Each window includes the cylindrical tubular vertical frame elements and upper horizontal frame elements of the T-shape configuration or at least having a central depending double wall flange. It will be appreciated that the upper surface of the frame elements 23 through 27 are horizontally planar having the slight gap 39 therebetween. The top of the communication wiring duct 17 is also planar so that each window is formed of the tubular vertical elements, a bottom element having a substantially planar top surface and a top element of the noted T-shape or with the depending central flange or flanges.

Figure 5:
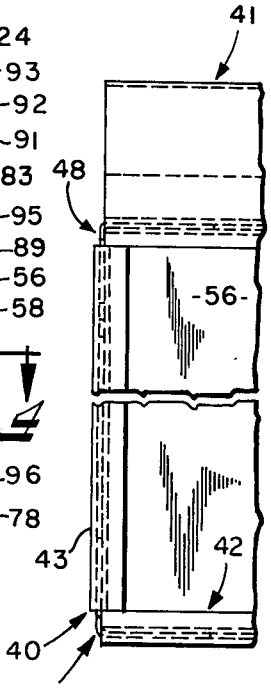
FIG. 5 is a side elevation of the frame of the pad with the other components removed.
Figure 6:
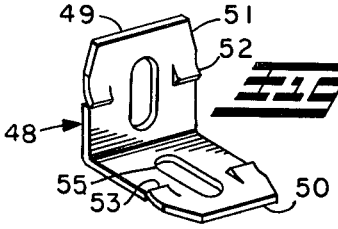
FIG. 6 is an isometric view of a metal corner clip utilized to secure the horizontal and vertical frame elements of the pad together.

Referring now to FIGS. 2, 5 and 6, it will be seen that the acoustical pad 37 may be constructed with an internal frame shown generally at 40 which includes a top horizontal frame member 41, a bottom frame member 42 and vertical or edge frame members 43. The frame members may be extruded vinyl, for example, and each have a common inwardly directed channel configuration with each inwardly directed leg 45 including a relatively short slot forming flange 46. In this manner, the frame members have the configuration of facing Fs connected along the top. The relatively short flanges or legs 46 form relatively narrow slots to receive the edges of angle clips 48 seen in detail in FIG. 6. There will be one angle clip at each corner of the rectangular frame. Each angle clip includes legs 49 and 50 of equal length extending at right angles to each other. The lateral edges of the ends of the legs may be slightly beveled or tapered as seen at 51 to facilitate the driving of the clip leg into the slot formed by the relatively short legs 46 and back of the channel-shaped frame members.

The lateral edge of each leg of the clip is provided with a biting tang 52 which may be struck from the body of the clip, such tang providing a biting edge 53 such that when the clip leg is driven into the channel noted, it will not readily come out. The frame 41 may thus be readily assembled by driving the legs of the clips into the open ends of the frame. The corner clips may be provided with openings 55 as seen to facilitate additional stitching or tacking as required.

When assembled, the frames will be assembled around and secure in the center a metal septum seen at 56. The septum may be 22 gage satin coated steel. On each side of the septum within the rectangular frame there is provided a fiberglass mat as seen at 57 and 58. The edges of the fiberglass mats underlie the inwardly projecting legs 45 of the channel frames and in this manner the frame holds the two panels of fiberglass and the metal septum together as a unit. The two panels of fiberglass may have a density of about 3 pounds per square foot.

It is noted that the top frame member 41, while including at the bottom edge thereof the inwardly directed facing F configuration of the other frame members, also includes integrally formed top hollow projections 60 and 61. The outer walls 62 of the projections are a planar continuation of the faces of the frame, while the inner walls extend upwardly initially vertically as seen at 63 and then inclined steeply at 64 to terminate in a relatively narrow horizontal wall 65. In this manner, the top frame member 41 forms an upwardly opening somewhat truncated V-shape slot 67.

In the full size pad embodiment of FIG. 2 the frame is covered with sponge or foam on each side as seen at 70 and 71. Such foam may be blocks of urethane elastomer foam of approximately 2.5 pounds per square foot density. The foam may be prefabricated in several pieces and as indicated the side piece 71 may extend beneath the bottom of the frame as indicated at 73. The foam pad 71 may also extend around the vertical sides. More than two foam pad elements may be provided if desired. It is noted that the pad elements are provided with rounded lower corners and also rounded top edges as seen at 75 and 76, which project above the relatively narrow top walls 65 of the frame 41.

The pad is provided with a one-piece prefabricated fabric pocket or covering 78. The fabric pocket may be in the general form of a pillow case into which the noted pad elements preassembled may readily be inserted. The free edges of the fabric pocket extend around the rounded top edges 75 and 76 and may be tucked into the slot 67 in the overlapping relationship seen at 80 and 81. The edges of the covering may then be stitched or stapled to the inside surface of the V-slot as seen at 82 and 83.

The slot 67 which extends along the entire top edge of the pads serves several purposes, one of which is to provide a stitching or tacking surface which is visually out of the way thus enabling the fabric cover to be tightly secured in place. The inclined walls of the V nonetheless provide access to the tacking or stitching surfaces to facilitate that operation and also to enable the pad to be recovered readily. The slot also serves to accomodate the upper frame member and to divide the top edge of the pad into two vertical edges which press against and conform to the underside of the horizontal legs of the angles 30 and 31 as seen at 85 and 86.

The most important purpose of the slot is to accomodate the stem of the T formed by the somewhat spaced vertical legs of the frame without inhibiting the function of such frames in hanging or supporting other components in the system. It is also a purpose of the slot to conform to the stem of the T or flanges rather snugly yet with sufficient clearance to enable the pad readily to be inserted and removed from the window frame.

For example, to insert the pad in the window, one first mates the groove with the tongue or depending flanges and then pivots the pad while held upwardly in such mating position to a vertical position into snug fit with the window as seen by the arrow 86 in FIG. 2. When first inserted, the inclined wall of the groove may be in a substantially vertical position flush against the depending stem of the T or flange. The pad may readily be removed in the same manner by simply forceably pushing it laterally at the bottom then pulling it downwardly to disengage the tongue and slot.

In FIG. 3 there is illustrated another embodiment of the pad which may incorporate cork or other composition tack boards 88 and 89 on one or both sides of the pad.

In order to support the tack boards in the proper spaced relationship with the other components of the pad, tack board extrusions 90 are employed to form a frame peripherally supporting the tack board in spaced but parallel relationship to the face of internal frame 40. The extrusion 90 includes a inwardly directed channel 91 which embraces the edge of the board 89, and a ninety degree bend 92 extends from the exterior of the channel which terminates in a horizontal extension having a short inwardly directed flange 93. The flange 93 serves both as a stiffener and as a abutment for the peripheral edge of the frame 40.

Positioned between the tack boards 88 and 89 and the frame 40 there is a half size foam pad 95 and positioned between the boards 88 and 89 and the fabric covering 78 there is a quarter-size foam covering 96. An additional full size foam pad may be provided along the bottom and along the side edges as seen at 98 in FIG. 3 and 99 in FIG. 4, respectively.

Although FIGS. 2 and 3 illustrate the preferred full size and tack board embodiments, respectively, it will be appreciated that pads utilizing the half size foam pad 95 may be directly fabric covered to provide a somewhat thinner pad or that the quarter size tack boards may be directly fabric covered without the quarter size foam covering 96 option.

It will also be appreciated that the embodiment of FIG. 3 insofar as the frame 40 and fabric covering 78 is concerned is identical to the full size pad embodiment of FIG. 2.

Figure 4:
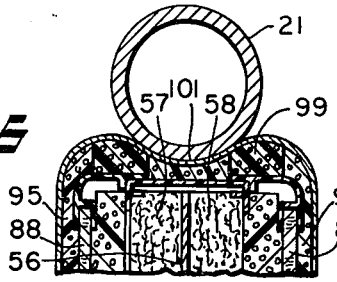
FIG. 4 is a horizontal section taken substantially on the line 4—4 of FIG. 3 illustrating the engagement of the pad with the vertical post.

As seen more clearly in FIG. 4, when the pad of either embodiment is inserted into the window frame between the vertical elements 20 and 21, the pad will deform along the vertical edges as seen at 101 in FIG. 4 to obtain a snug fit. It will, of course, also deform along the bottom edge projecting slightly into the gap 102 which will assist in retaining the pad in position. In any event, the pad deforms along both vertical edges, the relatively wide planar bottom edge, and at two horizontally spaced points along the top edge as seen at 85 and 86 to obtain a snug fit with the underside of the horizontally extending legs of the back-to-back angles. In this manner a visual and sound seal is provided by the pad along all surfaces of the window frame when the pad is in the inserted position.

It can now be seen that there is provided an acoustical pad for a space divider system of the type having T-shape horizontal frame elements at least along the top of a frame formed window, with the acoustical pad within such window secured against lateral displacement to the stem of the T and deformed at laterally spaced points against the underside of the head of the T as well as the vertical edges of the frame and a bottom surface of the frame.

We claim:

1. A readily removable and replaceable acoustical pad for an interior space dividing system of the type having horizontal and vertical frames forming generally rectangular pad receiving windows, the upper horizontal frame of each window having back-to-back slightly spaced depending flanges substantially coextensive with the window forming a tongue, said pad having a substantially central upwardly opening V-shaped groove along the top edge thereof only, said groove being at least partially defined by a pair of oppositely inclined surfaces and adapted to mate with the tongue so that the pad may be inserted in the window by first mating the groove with the tongue and then pivoting the pad along its top edge into a snug fit in the window.

2. A pad as set forth in claim 1 including foam covering at least two transversely spaced top edges separated by said groove and a parallel bottom edge, said foam covering said edges of said pad resiliently engaging the horizontal frames of said window to obtain said snug fit.

3. A pad as set forth in claim 1 wherein said groove is formed in part by the horizontal top element of an internal frame in said pad.

4. A pad as set forth in claim 3 wherein said internal frame includes horizontal and vertical frame elements interconnected by corner clips driven into locking engagement with said internal frame elements.

5. A pad as set forth in claim 4 wherein said corner clips comprise angles having right angle tongues adapted to be driven into slots in the ends of internal frame elements.

6. A pad as set forth in claim 5 wherein the edges of the tongues of said corner clips have tangs adapted to bite into such slots.

7. A pad as set forth in claim 6 including a metal septum dividing said internal frame vertically.

8. A pad as set forth in claim 7 including fiberglass pads within said internal frame on each side of said septum.

9. A pad as set forth in claim 8 including a foam covering on each side of said frame with a fabric envelope surrounding said foam covering.

10. A pad as set forth in claim 9 wherein the free edges of said fabric envelope are tucked into and secured within such groove.

11. A pad as set forth in claim 9 including a tack board between said foam covering and fabric.

12. A pad as set forth in claim 11 including a tack board frame supporting said tack board spaced from said internal frame.

13. A pad as set forth in claim 12 including a foam covering between said tack board and said fabric envelope.

14. A pad as set forth in claim 1 wherein said pad includes a rectangular frame which includes an upwardly opening V-shape element on the top thereof.

15. A pad as set forth in claim 1 including a fabric covering surrounding said pad which is tucked into and secured within said groove.

16. An acoustical pad for an interior space dividing system comprising a rectangular pad having yielding side and bottom edges, and transversely spaced yielding top edges separated by an upwardly opening V-shape groove, said groove being at least partially defined by a pair of oppositely inclined surfaces.

17. A pad as set forth in claim 16 wherein the interior of the groove is essentially unyielding.

18. A pad as set forth in claim 16 including a fabric covering the edges of such pad which are tucked into and secured within such groove.

19. A pad as set forth in claim 16 including a frame within the pad limiting and controlling the edge resilience of the pad.

20. An acoustical pad as set forth in claim 16 wherein the yielding peripheral edges of the pad enable the pad to be snugly fit into a framed window fully to close the same.

21. A pad as set forth in claim 16 wherein said groove is formed in part by the horizontal top element of an internal frame in said pad.

22. A pad as set forth in claim 21 wherein said internal frame includes horizontal and vertical frame elements interconnected by corner clips driven into locking engagement with said internal frame elements.

23. A pad as set forth in claim 22 wherein said corner clips comprise angles having right angle tongues adapted to be driven into slots in the ends of internal frame elements.

24. A pad as set forth in claim 23 wherein the edges of the tongues of said corner clips have tangs adapted to bite into such slots.

25. A pad as set forth in claim 24 including a metal septum dividing said internal frame vertically.

26. A pad as set forth in claim 25 including fiberglass pads within said internal frame on each side of septum.

27. A pad as set forth in claim 26 including a foam covering on each side of said frame with a fabric envelope surrounding said foam covering.

28. A pad as set forth in claim 27 wherein the free edges of said fabric envelope are tucked into and secured within such groove.

29. A pad as set forth in claim 27 including a tack board between said foam covering and fabric.

30. A pad as set forth in claim 29 including a tack board frame supporting said tack board spaced from said internal frame.

31. A pad as set forth in claim 30 including a foam covering between said tack board and said fabric envelope.

* * * * *